United States Patent [19]

Kautz, Jr.

[11] 4,061,204

[45] Dec. 6, 1977

[54] ENGINE PRE-OILER

[76] Inventor: Walter C. Kautz, Jr., 21707 NW. 51st Ave., Ridgefield, Wash. 98646

[21] Appl. No.: 656,140

[22] Filed: Feb. 9, 1976

[51] Int. Cl.[2] ..... F01M 9/00

[52] U.S. Cl. ..... 184/6.3; 123/196 S

[58] Field of Search ..... 184/6.3; 123/196 S

[56] References Cited

U.S. PATENT DOCUMENTS

| | | | |
|---|---|---|---|
| 2,225,539 | 12/1940 | Persson et al. | 123/196 S |
| 2,747,564 | 5/1956 | Wehling | 123/196 S |
| 2,755,787 | 7/1956 | Butler et al. | 184/6.3 |
| 3,422,807 | 1/1969 | Waldecker | 123/196 S |

FOREIGN PATENT DOCUMENTS

| | | | |
|---|---|---|---|
| 1,084,685 | 9/1967 | United Kingdom | 184/6.3 |

*Primary Examiner*—Samuel Feinberg

*Attorney, Agent, or Firm*—James D. Givnan, Jr.

[57] ABSTRACT

A pressurized vessel disclosed as an accumulator is in valve controlled communication with an oil gallery or passageway for pressurizing same prior to machinery motion. A solenoid actuated valve is energized to communicate the accumulator with the oil gallery. A flow control valve, between the accumulator and the oil gallery, automatically opens to release accumulator pressure and pump operation for recharging of the accumulator with pressurized oil during machinery operation.

2 Claims, 3 Drawing Figures

ENGINE PRE-OILER

BACKGROUND OF THE INVENTION

The present invention relates generally to a preoiling system for machinery bearings and parts for lubricating same prior to motion of the machinery.

Existing internal combustion engines, for example, rely on an oil pump driven in an accessory manner by the engine. As normal oil pressure does not occur until moments after engine starting is initiated, lubrication during cranking and start up is inadequate. Accordingly, a relatively high amount of wear occurs during cranking and the first moments of engine operation by reason of less than normal lubrication for a period of seconds or until the oil gallery and oil passageways are suitably pressurized. The advent of multi-viscosity oils has alleviated the problem to some degree in that such oil flows more rapidly than single viscosity oil however fast idle speeds during initial start up of the engine are common to modern automobile engines and can result in, at least momentarily inadequate engine lubrication.

To the extent the prior art is known, certain prior patents have been concerned with this problem but have endeavored to solve the problem by the aspiration of oil or oil vapor into the fuel intake system for lubrication of upper piston, cylinders and valve components with no provision made for lubricating other moving engine components. Similarly, other types of machinery are subject to inadequate lubrication prior to normal operation of the associated lubrication system.

SUMMARY OF THE PRESENT INVENTION

The present pre-oiling system embodies a pressurized oil vessel in controlled communication with an oil gallery with recharging of the vessel occurring subsequently during machine operation.

The oil vessel is presently in the form of an accumulator with accumulator contents being routed past a selectively operated valve, actuated during an engine starting sequence enabling pressurization of an oil gallery or passageway prior to machinery motion. Additional valve means unseats to discharge the oil. The last mentioned valve means additionally permits a metered, reverse flow for gradual refilling of the lubricant vessel during lubrication system operation. Desirably the pre-oiling system may be provided as an accessory to existing engines or other machinery with an oil supply line being in communication with lubrication system components such as a filter by-pass housing.

Important objects of the present system include: the provision of a pre-oiler pressurizing an oil gallery or passageway prior to motion of machine parts; the provision of a pre-oiler wherein the oil supply is gradually restored within a pressurized vessel during machinery operation; the provision of a pre-oiler including a pressurized oil vessel to provide oil under pressure to engine components prior to engine cranking; the provision of a compact pre-oiling system compatible with existing engine design to permit incorporation without radical modification of engine parts; the provision of a pre-oiler which enables the existing oil pressure warning light system to be utilized to indicate proper operation of the present pre-oiler; the provision of a pre-oiler incorporating valve means which permits a relatively high oil flow in one direction during engine starting and meters a restricted flow in an opposite direction during recharging of the oil vessel after engine starting; the provision of a pre-oiling system which may utilize highly reliable components of proven high reliability; and the provision of a pre-oiler including an accumulator to assure positive discharge of the oil therein.

DETAILED DESCRIPTION OF THE PREFERRED EMBODIMENT

Figure 1:
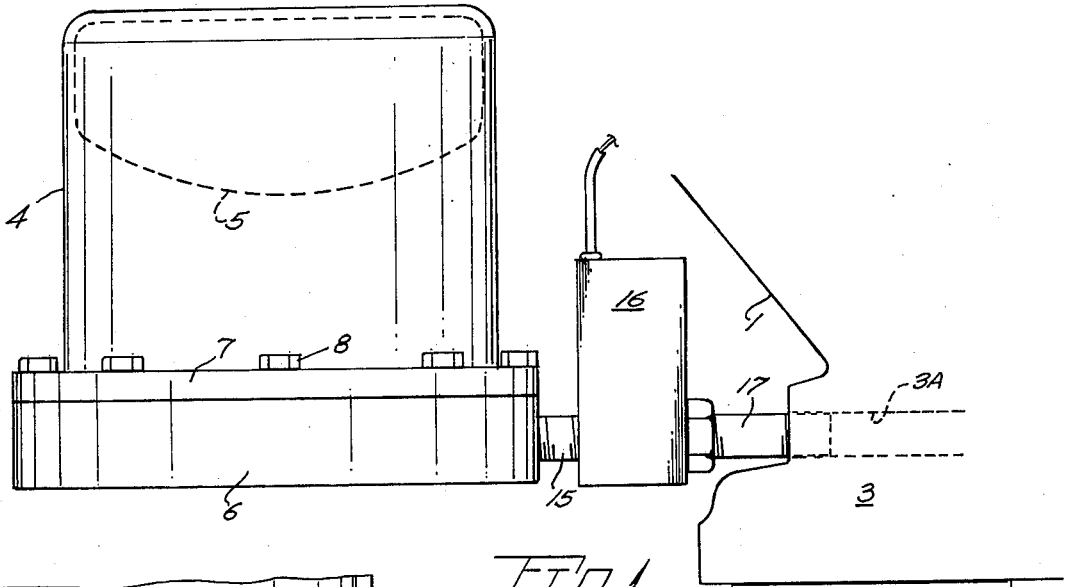
FIG. 1 is a view of the pre-oiler in place on an engine block.

With continuing reference to the accompanying drawing wherein applied reference numerals indicate parts similarly identified in the following specification, the reference numeral 1 indicates an engine block fitted with an oil filter 2 supported within a by-pass housing 3 all in the more or less conventional manner. Said housing defines an internal passageway 3A for the return of filtered oil to an engine oil gallery from whence passageways lead to various engine components. While the following described pre-oiler system is shown in association with one type of oil by-pass housing, it is to be understood that the present pre-oiler system may be adapted to suit various engines with or without similar by-pass housings. For example, the connection point between the pre-oiler and block may be at the oil pressure sensing unit location.

Figure 2:
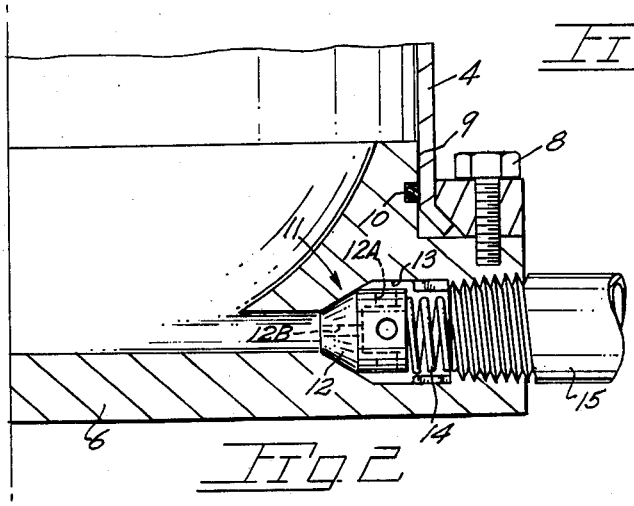
FIG. 2 is an enlarged fragmentary view with the accumulator with fragments broken away to show valve structure.

The present pre-oiler system includes an oil vessel in the form of an accumulator having a housing 4 within which is housed a pressurized bladder 5 of a non-constant volume with remaining accumulator area being occupied by a quantity of pressurized lubricant. As best viewed in FIG. 2, a retainer ring 7 secures the accumulator housing to an accumulator base 6 by means of fasteners 8. A seal such as an O-ring at 10 extends about a grooved upright well 9 of accumulator base 6 for sealing contact with an internal surface of housing 4.

Valve means includes a flow control valve assembly, indicated generally at 11, and desirably located within accumulator base 6 for reasons of compactness. Said valve assembly includes a movable valve body 12 disposed within a bore 13. A helical spring 14 urges valve body 12 to the seated FIG. 2 position formd a first position during engine operation as later more fully described. Valve ports at 12A are associated with the outflow of lubricant from the accumulator when said valve body is in an unseated or a second position while a port at 12B permits an opposite return, metered flow into the accumulator.

A valve assembly is indicated at 16 which is in communication with accumulator base 6 via a nipple 15. Said valve assembly regulates the communication of accumulator 4 with the engine oil gallery (or other lubricant passageway), the valve being open during engine operation. A second nipple at 17 interconnects solenoid valve 16 with bore 3A in the by-pass housing of the engine block.

Figure 3:
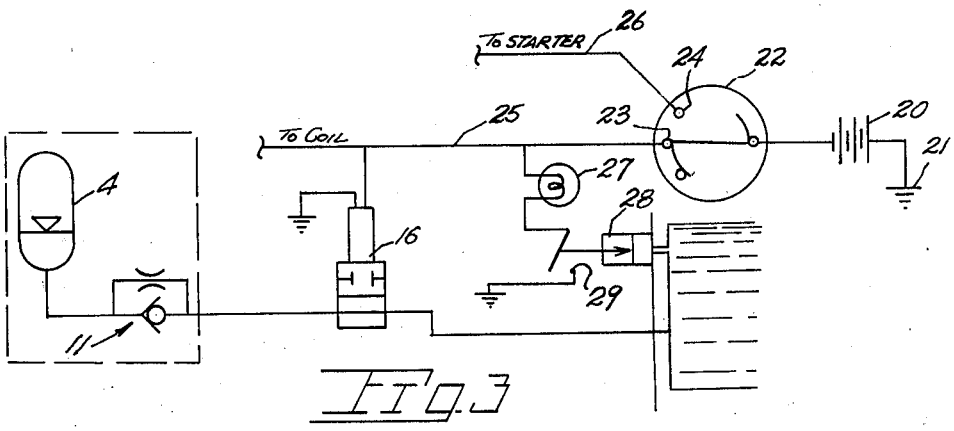
FIG. 3 is a diagrammatic of the present pre-oiler system in conjunction with engine ignition circuitry.

Basic components of an ignition circuit are shown in FIG. 3 including a power source 20 grounded at 21, a multi-position ignition switch 22 having representative contacts 23 and 24 which energize in sequence a primary ignition lead 25 to an ignition coil and a second lead at 26 to a starter motor. An oil pressure warning light 27 is in a conventional circuit with said source and grounded through a pressure responsive switch 28 with contacts 29.

In operation, manipulation of ignition switch 22 from its off position to the "on" position shown in FIG. 3 results in solenoid valve 16 being actuated to the open position shown. With solenoid valve 16 open, accumulator oil pressure unseats valve body 12 moving same to said second position whereby oil flows past flow control valve 11 (via ports 12A therein) to the engine oil gallery pressurizing same. Pressure responsive switch 28 opens upon such pressurization to interrupt the warning light circuit extinguising warning light 27 which indicates to the operator the pre-oiler system has functioned to pressurize the engine oil gallery (or other oil passageway) prior to motion of the parts requiring lubrication.

Upon engine staring with consequent operation of the oil pump, the oil gallery is pressurized in the normal manner, at which time, a metered reverse lubricant flow will take place past open control valve 16, through port 12B of seated valve body 12, into accumulator 4 resulting in same being repressurized for subsequent starts. The orifice 12B in valve member 12 restricts the return flow of lubricant to the extent that engine oil pressure is not reduced below a safe operating pressure.

While I have shown but one embodiment of the invention, it will be apparent to those skilled in the art that the invention may be embodied still otherwise for use with a wide array of machinery requiring lubrication without departing from the spirit and scope of the invention.

Having thus described the invention, what is desired to be secured under a Letters Patent is:

1. A pre-oiler system for pressurizing lubricant within machinery prior to normal operation of the machinery lubrication system, said pre-oiler system comprising, an oil vessel containing lubricant under pressure, said vessel including a base, means selectively communicating the oil vessel interior with a lubrication passageway of the machinery, said means remotely actuated upon closure of an electrical circuit preparatory to starting of the machinery, and a valve assembly regulating lubricant flow between said vessel and said selectively communicating means and including a spring biased movable valve body having a first position whereat a restricted return flow of lubricant may enter said vessel during normal operation of the machinery lubrication system to gradually charge said vessel while adequate machinery lubrication system pressure is maintained, said valve body having a second position permitting an oppositely directed outward flow of lubricant from said vessel for machinery lubrication at a greater rate than the first position flow rate of said valve body, said movable valve body having multiple ports therein some of which are closed in said first position while other of said ports at all times remaining open.

2. The pre-oiler system claimed in claim 1 wherein said valve body is housed within the vessel base to contribute towards a compact pre-oiler system.

* * * * *